US009828980B2

(12) United States Patent
Maier

(10) Patent No.: US 9,828,980 B2
(45) **Date of Patent: *Nov. 28, 2017**

(54) COMPRESSOR MOUNTING SYSTEM

(71) Applicant: Dresser-Rand Company, Olean, NY (US)

(72) Inventor: William C. Maier, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/614,857

(22) Filed: Jun. 6, 2017

(65) Prior Publication Data

US 2017/0268493 A1 Sep. 21, 2017

Related U.S. Application Data

(63) Continuation of application No. 14/224,332, filed on Mar. 25, 2014, now Pat. No. 9,702,354, which is a continuation of application No. 12/442,863, filed as application No. PCT/US2007/079350 on Sep. 25, 2007, now Pat. No. 8,733,726.

(60) Provisional application No. 60/826,876, filed on Sep. 25, 2006.

(51) Int. Cl.

| | |
|---|---|
| ***F04B 39/12*** | (2006.01) |
| ***F01C 21/00*** | (2006.01) |
| ***F04B 39/14*** | (2006.01) |
| ***F25D 23/00*** | (2006.01) |
| ***F04C 23/00*** | (2006.01) |
| ***F25B 31/02*** | (2006.01) |
| ***F04B 41/06*** | (2006.01) |

(52) U.S. Cl.

CPC ..... *F04B 39/12* (2013.01); *F01C 21/007* (2013.01); *F04B 39/14* (2013.01); *F04B 41/06* (2013.01); *F04C 23/001* (2013.01); *F25B 31/02* (2013.01); *F25D 23/006* (2013.01); *F25B 2400/075* (2013.01)

(58) Field of Classification Search

None

See application file for complete search history.

(56) References Cited

U.S. PATENT DOCUMENTS 2,204,510 A * 6/1940 Neeson ..... F25B 31/023 248/613

4,178,724 A * 12/1979 Bruno ..... E01B 31/17 451/347

(Continued)

*Primary Examiner* — Nkeisha Smith

(57) ABSTRACT

A mounting system for an industrial compression system including a first component close-coupled to a second component includes a first support for the first component. The first support is configured to resist movement of the first component in a first direction substantially horizontal relative to the first component, a second direction substantially vertical relative to the first component, and an axial direction relative to the first component. The mounting system also includes a second support for the second component. The second support is configured to resist movement of the second component in a first direction substantially horizontal relative to the second component and a second direction substantially vertical relative to the second component, wherein the second support permits movement of the second component in an axial direction relative to the second component.

20 Claims, 3 Drawing Sheets

(56) References Cited

U.S. PATENT DOCUMENTS 4,432,470 A * 2/1984 Sopha ..... B01J 4/008 222/135
4,862,568 A * 9/1989 Wankmuller ..... E02B 17/0034 29/26 B
4,993,682 A * 2/1991 Imai ..... F16F 15/08 248/635
5,030,067 A * 7/1991 Ushiota ..... F04B 41/02 417/234
5,048,302 A * 9/1991 Hagenlocher ..... G05D 23/1919 474/18
5,230,612 A * 7/1993 Murphy ..... F16M 1/00 248/638
5,322,307 A * 6/1994 Tilton ..... B02C 21/02 241/101.78
6,375,437 B1 * 4/2002 Nolan ..... F04B 35/06 137/248
6,629,825 B2 * 10/2003 Stickland ..... F04B 35/04 417/360
6,923,627 B1 * 8/2005 Wood ..... F04B 35/06 137/557
7,275,735 B2 * 10/2007 Brenneke ..... F04D 25/166 261/30
7,887,303 B2 * 2/2011 Sadkowski ..... F04B 35/06 417/234
7,909,584 B2 * 3/2011 Etter ..... F04B 41/02 417/234
8,511,981 B2 * 8/2013 Small ..... F04D 29/444 415/148
9,080,645 B2 * 7/2015 Hood ..... F01C 21/007
9,506,462 B2 * 11/2016 Oba ..... F04B 39/06
2007/0212235 A1 * 9/2007 MacNeil ..... F04B 17/03 417/361
2008/0273994 A1 * 11/2008 Sadkowski ..... F04B 35/06 417/234
2009/0053076 A1 * 2/2009 Vos ..... F04B 35/06 417/234
2010/0074768 A1 * 3/2010 Maier ..... F01C 21/007 417/360
2012/0039727 A1 * 2/2012 Klein ..... F04B 27/086 417/199.1
2015/0233364 A1 * 8/2015 Luby ..... F04B 35/06 137/899
2017/0016636 A1 * 1/2017 Koo ..... F24F 1/24

* cited by examiner

COMPRESSOR MOUNTING SYSTEM

CROSS-REFERENCE TO RELATED APPLICATIONS

This application is a continuation of U.S. patent application Ser. No. 14/224,332, filed on Mar. 25, 2014, which is a continuation of U.S. patent application Ser. No. 12/442,863, now U.S. Pat. No. 8,733,726, filed May 7, 2009, which is a National Stage Application of International Application Serial No. PCT/US2007/079350, filed Sep. 25, 2007, which claims priority to U.S. Provisional Patent Application Ser. No. 60/826,876, entitled "Compressor Mounting System", filed Sep. 25, 2006. The entire contents of all these applications are hereby incorporated by reference to the extent consistent with the present application.

BACKGROUND

The present disclosure relates to compressor mounting systems and, more particularly, to a pedestal based mounting system for a close-coupled industrial compression system including heat exchangers and gas break vessels.

As compression system technology has advanced, compression systems have become increasingly sophisticated and energy efficient. For example, heat exchangers and gas break vessels have been incorporated into compression systems as separate components integrated with the compressor and motor driver to improve system performance and efficiency. As a result of incorporating additional features such as heat exchangers, industrial compression systems have become larger and are commonly mounted with components connected end-to-end in a compression system train. While performance and efficiency has improved in these types of systems, the size and weight of such systems has grown.

To incorporate performance and efficiency advantages of components, such as heat exchangers, while maintaining a smaller package, a type of compression system is provided with a compressor close-coupled to an electric motor driver. This arrangement allows for a compact design with benefits over traditional base-plate mounted compressor trains. A further extension of this concept is to incorporate process heat exchangers into a compact interconnected package. Currently, process heat exchangers are mounted remotely from the compressor with long, voluminous extensions of interconnected process piping.

SUMMARY

Example embodiments disclosed provide a mounting system for an industrial compression system including a first component close-coupled to a second component. The mounting system includes a first support for the first component, the first support configured to resist movement of the first component in a first direction substantially horizontal relative to the first component, a second direction substantially vertical relative to the first component, and an axial direction relative to the first component. The mounting system also includes a second support for the second component, the second support configured to resist movement of the second component in a first direction substantially horizontal relative to the second component and a second direction substantially vertical relative to the second component, wherein the second support permits movement of the second component in an axial direction relative to the second component.

Example embodiments disclosed further provide a mounting system for a compression system having a motor dual-ended to a first compressor and a second compressor. The mounting system includes a first support for the first compressor, the first support configured to resist movement of the first compressor in a first direction substantially horizontal relative to the first compressor, a second direction substantially vertical relative to the first compressor, and an axial direction. The mounting system also includes a second support for the second compressor, the second support configured to resist movement of the second compressor in a first direction substantially horizontal relative to the first compressor, a second direction substantially vertical relative to the second compressor, and an axial direction. A beam extends between the first and second supports, wherein the beam supports the motor, and further wherein movement of the motor is permitted in an axial direction.

Other aspects of the example embodiments disclosed will become apparent by consideration of the detailed description and accompanying drawings.

Before any example embodiments of the present disclosure are explained in detail, it is to be understood that example embodiments are not limited in their application to the details of construction and the arrangement of components set forth in the following description or illustrated in the following drawings. Other example embodiments are also envisioned within the scope of this disclosure and may be practiced or carried out in various ways. Also, it is to be understood that the phraseology and terminology used herein is for the purpose of description and should not be regarded as limiting.

For example, terms like "central", "upper", "lower", "front", "rear", and the like are used to simplify description of the present disclosure, and do not alone indicate or imply that the device or element referred to must have a particular orientation. The elements of the industrial compressor mounting system referred to in the present disclosure can be installed and operated in any workable orientation desired. In addition, terms such as "first", "second", and "third", are used herein for purposes of description and are not intended to indicate or imply relative importance or significance.

DETAILED DESCRIPTION

Figure 1:
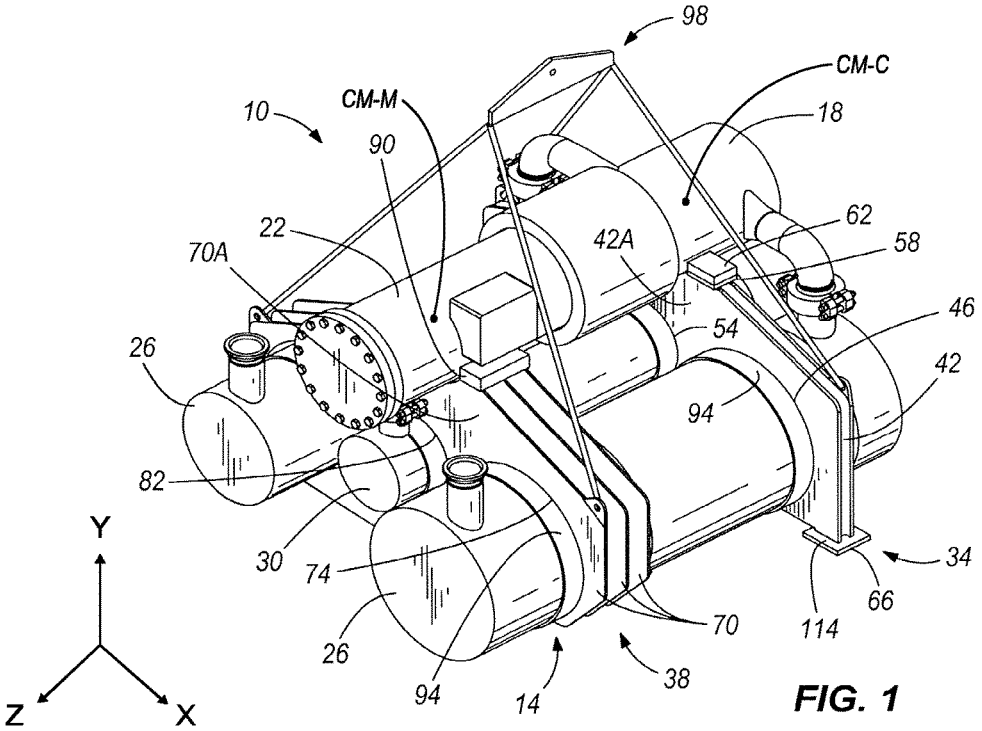
FIG. 1 is a perspective view of a close-coupled industrial compression system including a compressor mounting system according to an example embodiment.

FIG. 1 illustrates a close-coupled industrial compression system 10 utilizing a compressor mounting system 14 according to an example embodiment. A compressor 18 is connected to, and close-coupled with, a motor driver 22.

Heat exchangers 26 are mounted vertically below and horizontally outward from the close-coupled system 10, and a gas break vessel 30 is mounted vertically below the compressor 18 and the motor 22. All of these components are supported and positioned by the mounting system 14. In order to place the compressor 18, the motor 22, and the heat exchangers 26 in a compact package, the components are vertically and horizontally in close proximity in an interconnected relationship. The mounting system 14 may accommodate long and short time scale positional variations between the components in order to avoid machinery misalignment and transfer of large forces between the components. Additionally, the mounting system 14 supports the weight of each of the components.

The compressor mounting system 14 includes a rigid pedestal 34, and a partially-flexible pedestal 38. The pedestals 34, 38 provide a combination of rigid and flexible support that enables close-coupled, interconnection and support of the components of the industrial compression system 10. The mounting system 14 provides rigid support to the components that require rigid support (e.g., the compressor 18) and simultaneously provides flexible support of certain components (e.g., the motor 22) to permit relative movement in directions that are beneficial to operation and performance of the system 10. The mounting system 14 positions components vertically and horizontally with respect to each other in close proximity while permitting appropriate relative movement between the components.

Figure 2:
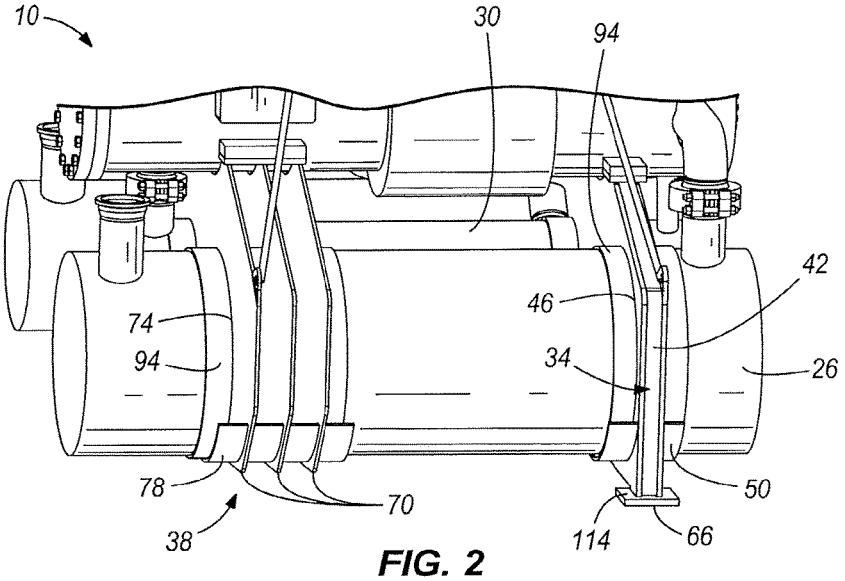
FIG. 2 is a front perspective view of the compressor mounting system shown in FIG. 1.

Referring to FIGS. 1 and 2, the pedestal 34 includes a generally rectangular pedestal plate 42 positioned approximately vertically under a center of mass CM-C of the compressor 18. The pedestal plate 42 includes openings 46 to position and support the heat exchangers 26 of the industrial compression system 10, whereby vessel supports 50 are positioned between the heat exchangers 26 and the plate 42. An opening 54 is also provided in the plate 42 for supporting the gas break vessel 30. An upper portion 42A of the plate 42 includes a flange plate 58 combined with a casing mount 62 for supporting the compressor 18 on the pedestal 34. In the illustrated embodiment, the rigid pedestal 34 is formed from a single plate; however, it should be readily apparent to those of skill in the art that in further embodiments any number of pedestal plates may be used (e.g., two plates axially coupled together). In still another embodiment, the plate may be fabricated from bolted sections split at the heat exchanger interface to allow easier assembly of the heat exchangers into the system 10.

The pedestal 34 supports the compressor 18, and is rigid, or stiff, in a vertical direction (generally along the Y-axis) and a horizontal direction (generally along the X-axis) relative to a supporting surface 66, as well as in an axial direction (generally along the Z-axis) of the compressor 18. It is generally desirable to support the compressor 18 in a fixed position. Rigidity is given to the pedestal 34 through a selection of material thickness of the plate 42 and appropriate structural re-enforcement.

The partially-flexible pedestal 38, is positioned approximately vertically under a center of mass CM-M of the motor 22, axially spaced from the pedestal 34. The pedestal 38 is rigid in a vertical direction (generally along the Y-axis) and a horizontal direction (generally along the X-axis) relative to the supporting surface 66, but is flexible, soft or compliant in an axial direction (generally along the Z-axis) relative to the motor 22. The pedestal 38 includes three flex plates 70, which support the motor 22 and provide axial compliance. The pedestal plates 70 include openings 74 to position and support the heat exchangers 26 of the industrial compression system 10, whereby vessel supports 78 are positioned between the heat exchangers 26 and the plates 70. Openings 82 are also provided in the plates 70 for supporting the gas break vessel 30. The plates permit relative axial movement of the heat exchangers 26 and the gas break vessel 30. An upper portion 70A of the flex plates 70 includes a casing mount 90 for supporting the motor 22 and permitting axial movement of the motor 22.

The pedestal 38 is rigid in some directions but flexible in others to permit movement in a manner that is non-detrimental to intercomponent positioning and operation. Flexible mounting is accomplished through flexible pedestals, isolation pads or bands, flex plates and flange plates. In a further embodiment, similar axial movement flexibility is obtained with a completely rigid pedestal (similar to compressor pedestal 34) including a system of axial keyways and sliding or rolling surfaces to allow the motor 22 and the heat exchangers 26 to freely move in an axial direction (generally along the Z-axis) without relatively shifting position in a vertical direction (generally along the Y-axis) or a horizontal direction (generally along the X-axis).

Isolation pads 94 are positioned in multiple locations within the mounting system 14 to permit relative axial movement between a structural support piece and the supported component. Referring to FIG. 2, isolation pads 94 are located at each connection between the pedestals 34, 38 and the heat exchangers 26 and the gas break vessel 30. The isolation pads 94 permit the heat exchangers 26 to move axially (and to a smaller extent, horizontally) with piping, or temperature induced loads without affecting alignment of the compressor 18, the motor 22 and the interconnecting piping. The isolation pads 94 also minimize transmission of flow induced vibrations from the heat exchanger 26 to the close-coupled compressor and motor unit. In the illustrated embodiment, the isolation pads 94 are formed by an elastomer band. In further embodiments, flexible support may be provided by other means, such as elastomer-mounted rollers, low friction pads, anti-friction bearings, or the like, to allow a larger degree of relative axial movement.

Figure 3:
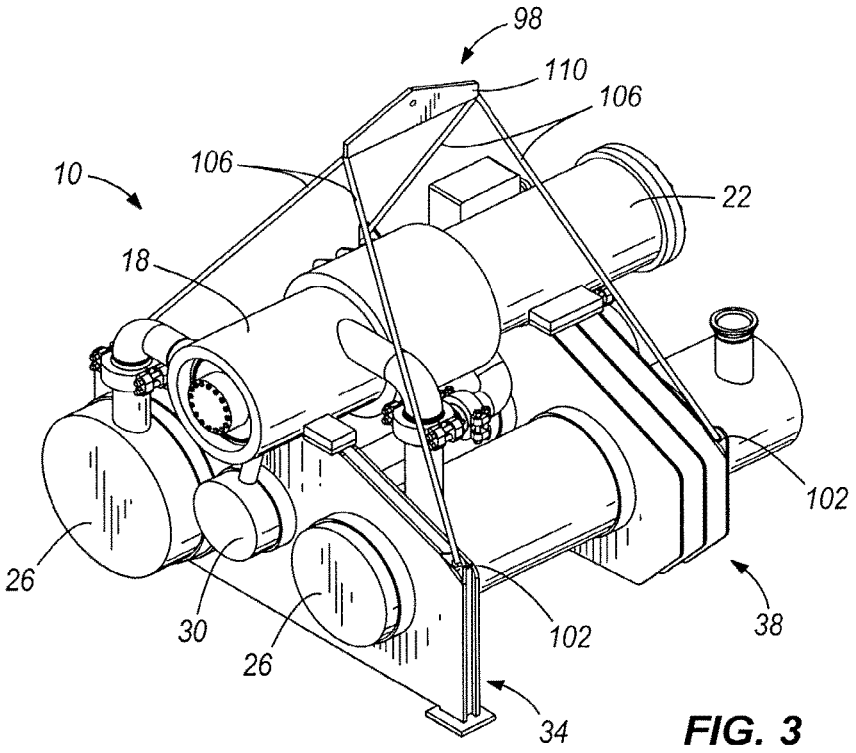
FIG. 3 is a rear perspective view of the compression system shown in FIG. 1, and illustrates lifting and transporting features of the compressor mounting system.

FIG. 3 illustrates a lifting system 98 that permits the industrial compression system 10 to be lifted and transported as a complete unit. The lifting system 98 includes lifting lugs 102 positioned at appropriate and strategic locations on the pedestals 34, 38. The lifting lugs 102 are connected with cables 106, or similar structures, such as rods, to a single point lift 110. The compression system 10 is lifted and transported through the single point lift 110.

Figure 4:
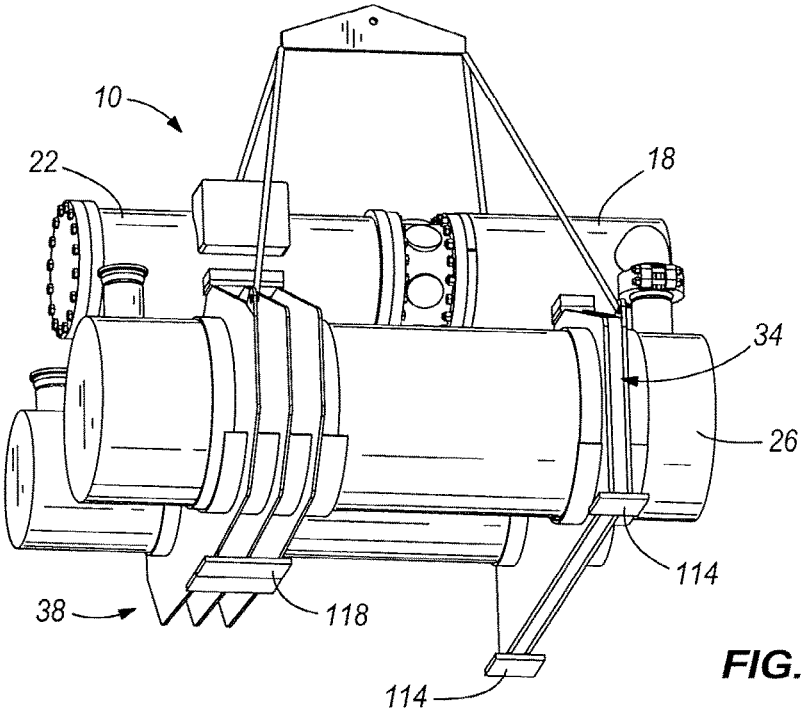
FIG. 4 is a bottom perspective view of the compressor mounting system shown in FIG. 1.

As shown in FIG. 4, the industrial compression system 10, along with the pedestals 34, 38, is supported by a three point mounting base system. The mounting base system includes two pedestal base supports 1 14 positioned on a lower face, and at each end, of the plates 42 of the pedestal 34. A third base support 1 18 is centrally located at a lower face of the plates 70 of the pedestal 30. The three base supports provide structural de-coupling between sub-base structures carrying the compression system 10 (such as an off-shore oil platform) and the compression system 10 itself. In a further embodiment, other base systems may be used.

It should be readily appreciated that the mounting system 14, as shown in FIGS. 1-4, supports the compressor 18, the motor 22, heat exchangers 26 and the gas break vessel 30 in a single package forming a relatively compact group of components. Thereby, interconnecting piping between components are shorter and comprised of smaller diameter piping than is typical in a widely-separated train-type configuration. Interconnecting mechanical structures, such as drive components between the motor driver 22 and the compressor 18 are also made shorter and more compact.

A combination of support structures form the mounting system 14, some of which are rigid in all three primary directions (generally along the X, Y, and Z axes illustrated in FIG. 1) and at least one of which is flexible in, at least, an axial direction (generally along the Z-axis illustrated in FIG. 1), and are combined to permit relative movement of close-coupled components in a manner that is beneficial to operation or performance of the compression system. While reference is made herein to the compressor mounting system 14 utilizing a single, rigid pedestal 34 and a single, combination rigid and flexible pedestal 38, it is contemplated that other example embodiments may utilize any number of each of the rigid pedestal and the combination rigid and flexible pedestal. It should be readily apparent to those of skill in the art that in a further embodiment, the pedestals 34, 38 may be reversed such that the rigid pedestal 34 supports the motor 22 and the partially-flexible pedestal 38 supports the compressor 18.

Figure 5:
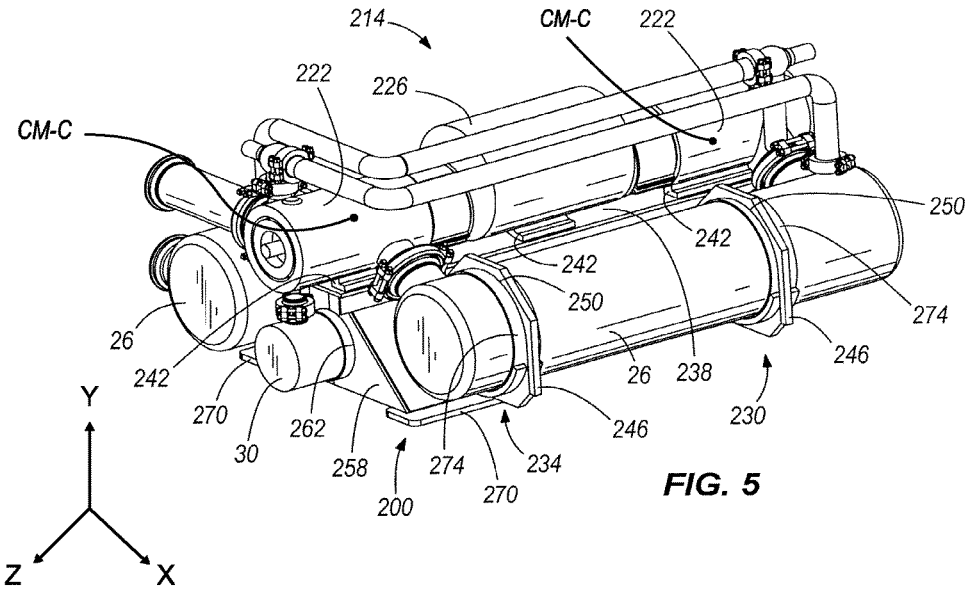
FIG. 5 is a perspective view of a compressor mounting system according to another example embodiment, and configured for use with a close-coupled, single drive, dual-compressor system.
Figure 6:
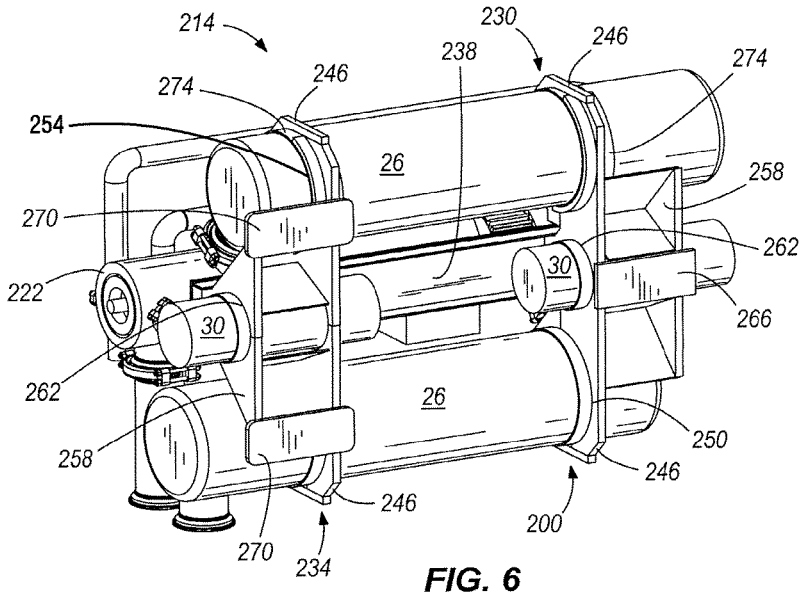
FIG. 6 is a bottom perspective view of the compressor mounting system shown in FIG. 5.

FIGS. 5 and 6 illustrate a compressor mounting system 200 according to another example embodiment. An industrial compression system 214 is a double compressor drive arrangement including a single electrical drive 226 dual-ended to power two compressors 222. Similar to the compression system 10 shown in FIGS. 1-4, heat exchangers 26 are mounted vertically below and horizontally outward from the close-coupled system 214, and gas break vessel 30 is mounted vertically below the compressors 222. All of these components are supported and positioned by the mounting system 200. In order to place the compressors 222, the electrical drive 226, and the heat exchangers 26 in a compact package, the components are vertically and horizontally in close proximity in an interconnected relationship.

The mounting system 200 employs isolation pads, flange plates and flex plates to permit positional variation of the components in specific locations and directions that are beneficial to system operation and performance. The mounting system 200 includes two rigid pedestals 230, 234, each of which supports a compressor 222 at a position close to the compressor's center of mass. The pedestals 230, 234 are connected together by a structural beam 238 extending between the pedestals 230, 234. Inter-casing flanges 242 are supported by the structural beam 238 to provide a connection that supports the compressors 222 and the electrical drive 226. The structural beam 238 is structurally sufficient to hold the weight of the dual-ended electrical drive 226 when one or both of the compressors 222 are removed for service. The pedestals 230, 234 are also provided with openings for the heat exchangers 26 and the gas break vessels 30 which are mounted with a structure similar to the mounting utilized in FIGS. 1-4 to permit relative axial movement (generally along the Z-axis) between the pedestals 230, 234 and the heat exchangers 26 and the gas break vessels 30.

Each pedestal 230, 234 includes a plate 246 positioned under a center of mass CM-C for the respective compressor 222. Each plate 246 includes openings 250 to position and support the heat exchangers 26 of the industrial compression system 214, whereby vessel supports 254 are positioned between the heat exchangers 26 and the plates 246. A pedestal base 258 is coupled to each plate 246. Each base 258 includes openings 262 for supporting the gas break vessels 30. Each base 258 has a generally pyramidal shape for distributing weight of the compression system 10.

Referring to FIGS. 5 and 6, in the illustrated embodiment, a three point mounting base system support the pedestals 230, 234. The first pedestal 230 includes a base mount 266 centered on a lower face of the associated pedestal base 258, and the second pedestal 234 includes a pair of base mounts 270 coupled to the lower face of the associated pedestal base 258. As discussed above, isolation pads 274 are positioned between the pedestals 230, 234 and the heat exchangers 26 and the gas break vessels 30 to permit axial movement (generally along the Z-axis) of the components without affecting alignment thereof.

The embodiments described above and illustrated in the figures are presented by way of example only and are not intended as a limitation upon the concepts and principles of the present disclosure. As such, it will be appreciated by one having ordinary skill in the art that various changes in the elements and their configuration and arrangement are possible without departing from the spirit and scope of the present disclosure.

Since other modifications, changes and substitutions are intended in the foregoing disclosure, it is appropriate that the appended claims be construed broadly and in a manner consistent with the scope of the present disclosure.

I claim:

1. A compression system, comprising:

a compressor configured to compress a process fluid;

a motor coupled to and configured to drive the compressor; and a mounting system, comprising:

a first support coupled to the compressor, the first support comprising a pedestal plate positioned under a center of mass of the compressor and configured to resist movement of the compressor in a first direction substantially horizontal relative to the compressor, a second direction substantially vertical relative to the compressor, and an axial direction relative to the compressor, and a second support coupled to the motor, the second support configured to resist movement of the motor in a first direction substantially horizontal relative to the motor and a second direction substantially vertical relative to the motor, and permit movement of the motor in an axial direction relative to the motor.

2. The compression system of claim 1, wherein the pedestal plate is rigid in the first direction substantially horizontal relative to the compressor, the second direction substantially vertical relative to the compressor, and the axial direction relative to the compressor.

3. The compression system of claim 1, wherein the second support comprises a plurality of flexible plates positioned under the motor, and wherein each flexible plate of the plurality of flexible plates is rigid in the first direction substantially horizontal relative to the motor and the second direction substantially vertical relative to the motor, and flexible in the axial direction relative to the motor.

4. The compression system of claim 1, further comprising a lifting system coupled to the first support and the second support, the lifting system comprising:

a first lifting lug coupled to the first support;

a second lifting lug coupled to the second support; a point lift; and cables extending between the first lifting lug, the second lifting lug, and the point lift.

5. The compression system of claim 1, further comprising a pair of heat exchangers disposed below and interconnected with the compressor and the motor to cool the process fluid, each heat exchanger of the pair of heat exchangers extending between the first support and the second support.

6. The compression system of claim 5, wherein each heat exchanger of the pair of heat exchangers is disposed in an opening of a plurality of openings in the first support and an opening of a plurality of openings in the second support.

7. The compression system of claim 6, further comprising at least one isolation pad disposed between the first support and each heat exchanger of the pair of heat exchangers.

8. The compression system of claim 6, further comprising at least one isolation pad disposed between the second support and each heat exchanger of the pair of heat exchangers.

9. The mounting system of claim 1, further comprising a gas break vessel extending between the first support and the second support, the gas break vessel disposed in a gas break vessel opening defined by each of the first support and the second support.

10. A compression system, comprising:

a first compressor configured to compress a process fluid;

a second compressor configured to compress the process fluid;

a motor having a first end coupled to the first compressor and a second end coupled to the second compressor, the motor being configured to drive the first compressor and the second compressor; and a mounting system, comprising:

a first support coupled to the first compressor, the first support configured to resist movement of the first compressor in a first direction substantially horizontal relative to the first compressor, a second direction substantially vertical relative to the first compressor, and an axial direction relative to the first compressor, a second support coupled to the second compressor, the second support configured to resist movement of the second compressor in a first direction substantially horizontal relative to the second compressor, a second direction substantially vertical relative to the second compressor, and an axial direction relative to the second compressor, and a beam extending between the first support and the second support, the beam configured to support at least the motor.

11. The compression system of claim 10, wherein the first support comprises: a plate positioned under a center of mass of the first compressor;

a base coupled to the plate; and a base mount coupled to the base and the plate, the base mount configured to support the first support on a supporting surface.

12. The compression system of claim 10, wherein the second support comprises: a plate positioned under a center of mass of the second compressor;

a base coupled to the plate; and at least one base mount coupled to the base and the plate, the base mount configured to support the second support on a supporting surface.

13. The compression system of claim 10, further comprising a pair of heat exchangers disposed below and interconnected with the first compressor, the second compressor, and the motor to cool the process fluid, each heat exchanger of the pair of heat exchangers extending between the first support and the second support.

14. The compression system of claim 13, wherein each heat exchanger of the pair of heat exchangers is disposed in an opening of a plurality of openings in the first support and an opening of a plurality of openings in the second support.

15. The compression system of claim 14, further comprising at least one isolation pad disposed between the first support and each heat exchanger of the pair of heat exchangers.

16. The compression system of claim 14, further comprising at least one isolation pad disposed between the second support and each heat exchanger of the pair of heat exchangers.

17. The compression system of claim 10, further comprising a gas break vessel disposed in at least one of an opening defined in the first support and an opening defined in the second support.

18. A compression system, comprising:

a first compressor configured to compress a process fluid;

a second compressor configured to compress the process fluid;

a motor having a first end coupled to the first compressor and a second end coupled to the second compressor, the motor being configured to drive the first compressor and the second compressor; and a mounting system, comprising:

a first support for the first compressor, the first support comprising:

a first plate disposed under a center of mass of the first compressor, a first base coupled to the first plate, and a first base mount coupled to the first base and the first plate, the first base mount configured to support the first support on a supporting surface, and a second support for the second compressor, the second support comprising:

a second plate disposed under a center of mass of the second compressor, a second base coupled to the second plate, and a second base mount and a third base mount, each of the second base mount and the third base mount coupled to the second base and the second plate and configured to support the second support on the supporting surface.

19. The compression system of claim 18, further comprising a beam extending between the first support and the second support, the beam configured to support the first compressor, the second compressor, and the motor.

20. The compression system of claim 18, further comprising a pair of heat exchangers disposed below and interconnected with the first compressor and the second compressor to cool the process fluid, each heat exchanger of the pair of heat exchangers being disposed in an opening of a plurality of openings in the first plate and an opening of a plurality of openings in the second plate.

* * * * *